United States Patent [19]

Deuber et al.

[11] 4,088,549

[45] May 9, 1978

[54] BRIGHT LOW KARAT SILVER GOLD ELECTROPLATING

[75] Inventors: John Martin Deuber, Nutley; Peter Stevens, Parsippany, both of N.J.

[73] Assignee: Oxy Metal Industries Corporation, Warren, Mich.

[21] Appl. No.: 676,439

[22] Filed: Apr. 13, 1976

[51] Int. Cl.[2] ..... C25D 3/62; C25D 3/64; C25D 3/56

[52] U.S. Cl. ..... 204/43 G; 204/43 R; 204/DIG. 2

[58] Field of Search ..... 204/43 G, 43 R, DIG. 2

[56] References Cited

U.S. PATENT DOCUMENTS

| | | | |
|---|---|---|---|
| 2,660,554 | 11/1953 | Ostrow | 204/43 G |
| 2,967,135 | 1/1961 | Ostrow et al. | 204/43 G |
| 3,642,589 | 2/1972 | Nobel et al. | 204/44 |
| 3,864,222 | 2/1975 | Wilson et al. | 204/43 G |

*Primary Examiner*—F.C. Edmundson

*Attorney, Agent, or Firm*—Richard P. Mueller; B. F. Claeboe; Arthur E. Kluegel

[57] ABSTRACT

Disclosed is an aqueous electroplating bath and process for obtaining bright deposits of silver-gold alloys. The bath contains a polyakylene imine and an alkylene polyamine.

8 Claims, No Drawings

BRIGHT LOW KARAT SILVER GOLD ELECTROPLATING

BACKGROUND OF THE INVENTION

This invention relates to the art of electrodepositing silver-gold alloys. More particularly, it relates to the art of electrodepositing silver-gold alloys of improved brightness from stable electroplating baths.

Amine compounds have been employed in the past as additions to gold or gold alloy electroplating baths. U.S. Pat. No. 2,660,554 suggests the addition of substituted ammonia compounds such as ethylene diamine, diethylene triamine and tetraethylene pentamine to gold or gold alloy electroplating baths of alkaline pH value. U.S. Pat. No. 2,967,135 suggests the same for baths of acidic pH values. The concentration of such amines required to brighten is shown to be 5g/l and upward.

Substitution of polyalkylene imines for the above alkylene polyamines has been suggested in U.S. Pat. No. 3,864,222. According to the patent, improved deposit quality could be obtained with the polyalkylene imine additives without the loss of stability normally inherent in plating baths containing alkylene polyamines or "substituted ammonia" compounds.

SUMMARY OF THE INVENTION

It has now been discovered that stable aqueous electoplating baths capable of plating silver-gold alloys may be obtained by including both a polyalkylene imine and an alkylene polyamine to the bath. When both components are present the bath is stable and bright deposits may be obtained even at low additive concentrations. Low concentrations are desired because drag-out losses are thereby minimized rendering the process more economical. Also, higher concentrations increase stress in the deposit and lead to a build up of undesirable organic byproducts in the bath which result in occlusion of organics in the deposit degrading its properties.

DETAILED DESCRIPTION OF THE INVENTION

The gold and silver components of the present invention are present in the aqueous bath in any suitable electodepositable form. Preferably the gold is present as the aurocyanide complex and silver is likewise present as the cyanide complex though they may be added as other salts and converted to the cyanide by separate addition of a soluble cyanide compound. The bath typically contains 1–30g/l of gold and 0.1 to 20g/l of silver.

The polyakylene imine compound is obtained by the polymerization of an alkyalene imine compound in the manner described in U.S. Pat. No. 3,864,222 and in publications of The Dow Chemical Co. Such compounds are available commercially, for example, as polyethyleneimine compounds supplied under the PEI trademark manufactured by the Dow Chemical Company. Molecular weights of such products vary from 300 up to 100,000 amd more. Preferably, the polyalkylene imine compounds employed herein have molecular weights less than 10,000 and most preferably less than 1,000. The concentrations of the imine polymer in the present invention may be very low with values in the range of 1–10m/l found to be useful, though higher concentrations may be employed. Adverse effects on the bath stability and organics occlusion are minimized when the concentration is below 1g/l.

The alkylene polyamine may be any compound of the formula $NH_2(RHN)nH$ wherein R is ethylene, propylene or their hydroxy derivatives and *n* is an integer from 1 to 6. Examples include ethylene diamine, diethylene triamine, triethylene tetramine and tetraethylene pentamine. Concentrations much lower than previously recognized may be employed. Values less than 5g/l, e.g., 50mg/l, are preferred though higher values may be used. the lowest concentration capable of achieving the desired brightness is preferred because higher concentrations contribute to the problems identified above.

Additional components may optionally be included in the plating bath to improve conductivity, adjust pH, improve wetting or complex bath components or impurities. These include the non-reactive inorganic conductive salts, such as potassium pyrophosphate, pH adjusting and non-interfering organic or inorganic acids or bases such as the alkali metal hydroxides or phosphoric acid, wetting agents such as partially esterfied forms of phosphoric acid, or complexing agents such as alkali metal cyanides and the phosphonic or carboxylic acid chelating agents. Properties of the deposit may be further modified through the inclusion of small quantities of tertiary alloying components. The base metals of group VIIIb and nickel or cobalt in particular are most useful tertiary components although indium and copper can also be beneficial.

The pH value of the plating bath will be adjusted depending upon the form of gold and silver employed in the bath. Where the preferred cyanide components are employed, the bath will be maintained at an alkaline pH, preferably between 9 and 11. Suitable bath temperatures are between 55° and 110° F with the preferred being 65°–75° F. Current densities may be from 1 to 25 ASF with values of 3–7 being preferred.

EXAMPLE 1

An aqueous bath was prepared to contain:

| Component | Concentration g/l |
|---|---|
| potassium gold cyanide | 8 as Au |
| potassium silver cyanide | 2 as Ag |
| potassium pyrophosphate | 46 |
| potassium cobalt cyanide | 0.6 as Co |
| diethylene triamine | 0.5 |

Plating was conducted on brass test panels at 5 ASF, 70° F and a pH of 9.5. The resulting deposit was white and hazy.

EXAMPLE 1A

Example 1 was repeated except 5mg/l of PEI 6, a polyethylene imine of about 600 molecular weight supplied by The Dow Chemical Co., was substituted for the diethylene triamine of Example 1. Again, the deposit was hazy except in the very high current density areas at the panel edge.

EXAMPLE 1B

Example 1 was repeated except 5mg/l of PEI 6 was included as an added component. The bath containing both the polyethylene imine and the alkalene polyamine yielded fully bright deposits.

Similar results were observed when nickel was employed in place of cobalt and when only gold and silver were employed as the depositable bath components.

We claim:

1. An aqueous alkaline electroplating bath having a pH within the range of about 9 to 11 and suitable for depositing silver-gold alloys comprising gold and silver in depositable form and containing as additional components about 0.001 to 0.1 g/l of a polyalkleneimine, and not more than about 5.0 g/l of an alkylene polyamine, whereby the bath is relatively stable, drag-out losses are minimized and fully bright deposits are obtained from said bath.

2. An electroplating bath as defined in claim 1, in which the alkylene polyamine is selected from the group consisting of ethylene diamine, diethylene triamine, triethylenetetramine, tetraethylene pentamine, pentaethylene hexamine the propylene homologs of the foregoing and the hydroxy derivatives of any of the foregoing.

3. An electroplating bath as defined in claim 1, in which the polyalkyleneimine is polyethyleneimine.

4. An electroplating bath as defined in claim 1, in which the molecular weight of the polyalkyleneimine is between about 600 and 100,000 and the molecular weight of the alkylene polyamine does not exceed about 500.

5. An electroplating bath as defined in claim 1, in which there is also present a conducting salt.

6. An electroplating bath as defined in claim 1, in which there is also present a chelating agent.

7. An electroplating bath as defined in claim 1, in which there is present a wetting agent.

8. An electroplating process comprising electrolysing the bath of claim 1, with a conductive surface as the cathode.

* * * * *